US009315992B2

(12) United States Patent
Carey

(10) Patent No.: US 9,315,992 B2
(45) Date of Patent: Apr. 19, 2016

(54) CONVEX STRUCTURAL BLOCK FOR CONSTRUCTING PARABOLIC WALLS

(71) Applicant: Leslie John Carey, Richmond, KY (US)

(72) Inventor: Leslie John Carey, Richmond, KY (US)

(73) Assignee: Geovent LLC, Richmond, KY (US)

( * ) Notice: Subject to any disclaimer, the term of this patent is extended or adjusted under 35 U.S.C. 154(b) by 0 days.

(21) Appl. No.: 13/769,795

(22) Filed: Feb. 18, 2013

(65) Prior Publication Data

US 2014/0053493 A1 Feb. 27, 2014

Related U.S. Application Data

(60) Provisional application No. 61/600,584, filed on Feb. 18, 2012, provisional application No. 61/684,176, filed on Aug. 17, 2012.

(51) Int. Cl.

| | |
|---|---|
| ***E04B 5/00*** | (2006.01) |
| ***E04C 1/40*** | (2006.01) |
| ***E04B 2/46*** | (2006.01) |
| ***E04B 2/48*** | (2006.01) |
| ***E04B 2/52*** | (2006.01) |
| ***E04C 1/39*** | (2006.01) |
| *E04B 2/02* | (2006.01) |

(52) U.S. Cl.

CPC ... *E04C 1/24* (2013.01); *E04B 2/46* (2013.01); *E04B 2/48* (2013.01); *E04B 2/52* (2013.01); *E04C 1/395* (2013.01); *E04C 1/40* (2013.01); *E04B 2002/023* (2013.01); *E04B 2002/0265* (2013.01)

(58) Field of Classification Search

CPC ..... E04B 2002/023; E04B 2002/0265; E04B 2/46; E04B 2/48; E04B 2/52; E04C 1/24; E04C 1/395; E04C 1/40

USPC ..... 52/245, 246, 247, 561, 562, 564, 565, 52/566, 567, 568, 596, 600, 601, 603, 604, 52/606, 607, 608, 609, 610; 405/284, 285, 405/286

See application file for complete search history.

(56) References Cited

U.S. PATENT DOCUMENTS

| | | | | |
|---|---|---|---|---|
| 894,122 | A * | 7/1908 | Dougherty | 52/302.4 |
| 1,156,468 | A * | 10/1915 | Dochnal | E04H 7/18 52/249 |
| 2,032,852 | A * | 3/1936 | Powell | 52/396.08 |
| 2,313,363 | A * | 3/1943 | Schmitt | 405/286 |
| 3,170,201 | A * | 2/1965 | Nofziger | 52/844 |
| 3,686,791 | A * | 8/1972 | Mills | 47/83 |
| 3,905,170 | A * | 9/1975 | Huettemann | 52/591.1 |

(Continued)

FOREIGN PATENT DOCUMENTS

| | | | | |
|---|---|---|---|---|
| DE | 3347366 | A1 * | 8/1984 | E04C 1/08 |
| DE | 19845643 | A1 * | 4/2000 | E04C 2/04 |

(Continued)

*Primary Examiner* — Charles A Fox
*Assistant Examiner* — Joseph J Sadlon
(74) *Attorney, Agent, or Firm* — James M. Francis

(57) ABSTRACT

A cementitious, convex structural block for forming parabolic walls is disclosed. The block utilizes a key and the keyway to facilitate placement and to add strength to the wall. The parabolic shape of the wall increases its compressive strength and when used underground as a seal or stopping in mining applications channels force from blast waves and dammed water into the mine shaft ribs. When constructed from a geopolymer, the block is lighter and has a smaller carbon footprint than cement.

11 Claims, 10 Drawing Sheets

(56) References Cited

U.S. PATENT DOCUMENTS

| | | | | | |
|---|---|---|---|---|---|
| 3,967,451 | A * | 7/1976 | Garbe | E04H 7/18 | 405/57 |
| 4,092,811 | A * | 6/1978 | Lin et al. | 52/223.3 | |
| 4,349,293 | A * | 9/1982 | Rosenberger | 404/41 | |
| 5,062,610 | A * | 11/1991 | Woolford et al. | 249/52 | |
| 5,308,196 | A * | 5/1994 | Frederick | 405/288 | |
| 5,385,504 | A * | 1/1995 | Hussey et al. | 454/169 | |
| 6,234,721 | B1 * | 5/2001 | Cronkhite | E02D 29/025 | 405/284 |
| 6,394,707 | B1 * | 5/2002 | Kennedy et al. | 405/288 | |
| 6,632,048 | B2 * | 10/2003 | Greenberg | 405/284 | |
| 6,668,484 | B2 * | 12/2003 | Riccobene | A01G 1/08 | 256/19 |
| 6,851,235 | B2 * | 2/2005 | Baldwin | 52/309.17 | |
| 6,912,823 | B2 * | 7/2005 | MacDonald et al. | 52/574 | |
| 6,915,614 | B2 * | 7/2005 | Matsufuji | 52/600 | |
| 7,204,060 | B2 * | 4/2007 | Hunt | 52/284 | |
| 7,712,281 | B2 * | 5/2010 | Bott | 52/604 | |
| 8,656,673 | B2 * | 2/2014 | Yang | F17C 1/08 | 52/245 |
| 8,656,678 | B2 * | 2/2014 | MacDonald | 52/562 | |
| 8,684,635 | B2 * | 4/2014 | Rainey | 405/284 | |
| 2005/0178081 | A1 * | 8/2005 | Bott | 52/596 | |
| 2008/0267718 | A1 * | 10/2008 | Costin | 405/262 | |
| 2011/0013991 | A1 * | 1/2011 | Watson et al. | 405/284 | |

FOREIGN PATENT DOCUMENTS

| | | | | |
|---|---|---|---|---|
| EP | 52082 | A1 * | 5/1982 | E04B 1/08 |
| EP | 0584053 | A1 * | 2/1994 | E02D 29/02 |
| FR | 2693755 | A1 * | 1/1994 | E04C 1/00 |
| WO | WO 0047828 | A1 * | 8/2000 | E02D 29/025 |
| WO | WO 0235015 | A1 * | 5/2002 | E01F 8/0035 |

* cited by examiner

Fig. 7
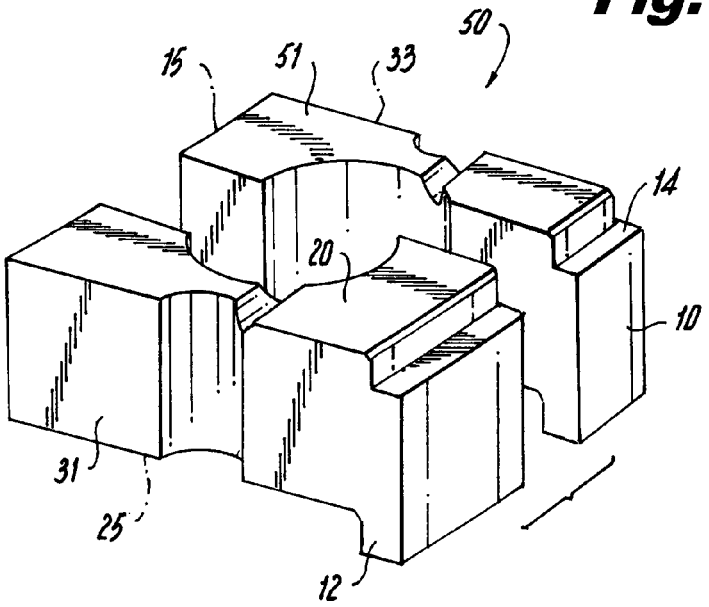
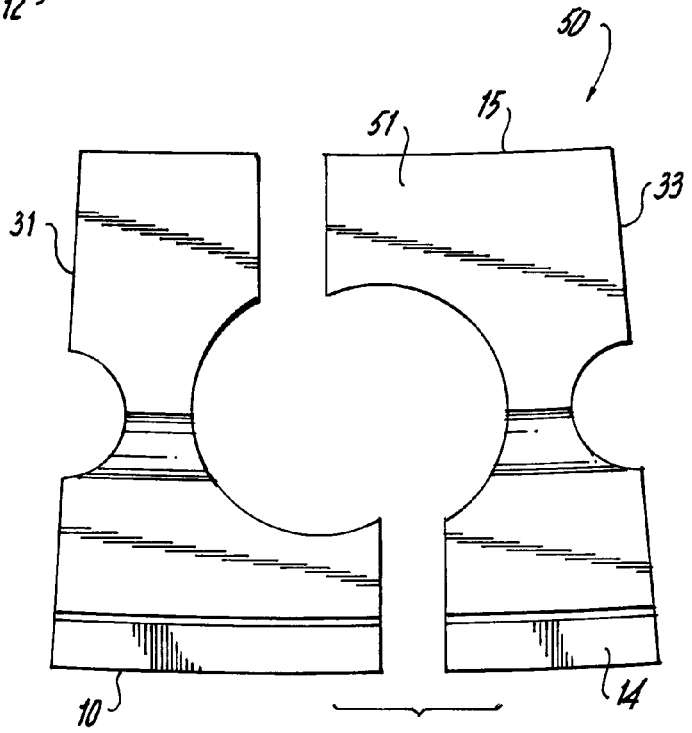
Fig. 8

CONVEX STRUCTURAL BLOCK FOR CONSTRUCTING PARABOLIC WALLS

CROSS REFERENCE TO RELATED APPLICATIONS

The present application relates to U.S. Provisional Patent Application 61/600,584 filed Feb. 18, 2012 and U.S. Provisional Patent Application 61/684,176 filed Aug. 17, 2012. The Applicant hereby incorporates the aforementioned US Provisional Patent Applications as if fully set forth herein.

FEDERALLY SPONSORED RESEARCH OR DEVELOPMENT

Not Applicable.

TECHNICAL FIELD

Disclosed is a structural block designed for the construction of safe rooms, ventilation control structures, retaining walls, seals, and stoppings. The block is preferably composed of cement or an environmentally friendly, lightweight cementitious material.

DEFINITIONS

The following definitions are intended to clarify the terminology used herein.

Cementitious: having the properties of cement; e.g. a building material which may be mixed with a liquid, such as water, to form a paste which may be pumped or poured into a mold or other cavity, and then cured to form a solid.

Drivage: A general term for a roadway, heading, or tunnel in course of construction. It may be horizontal or inclined but not vertical.

Geopolymer: an inorganic polymeric material comprised of chains or networks of mineral molecules linked with covalent bonds.

Mains (i.e. Main Roadways): Major travel-way of a mine. Starting at the portal and usually continuing to the farthest extent of the mine.

Overcast: A structure that channels intake and return air courses through a main roadway intersection.

Rib: The side of a pillar or the wall of an entry, e.g. the solid coal on the side of any underground passage.

Roadway: An underground drivage. It may be a heading, gate, stall, crosscut, level, or tunnel and driven in coal, ore, rock or in the waste area. It may form part of longwall or board-and-pillar workings or an exploration heading. A roadway is not steeply inclined.

Roof: The ceiling of a roadway.

Seals: A permanent solid wall built across a mine roadway or shaft.

Stopping: A temporary solid wall built across a mine roadway or shaft. A stopping is typically constructed to channel fresh air (intake air) to working areas and channel contaminated air (return air) away from the working area as in the construction of a ventilation control device.

BACKGROUND

Underground mines must be properly ventilated so as to provide a substantially continuous flow of fresh air of sufficient volume to dilute and remove dangerous particulates like rock and coal dust and toxic gases such as $CH_4$, CO, $CO_2$, $NO_x$, and $SO_2$. These gases are created by the combustion of fuel by engines used underground in various applications and from blasting with explosives. Toxic gases can also be released from the strata itself. Methane, $CH_4$, is of particular interest in coal mining since the gas is often found alongside coal deposits and because accumulations of this gas are odorless and can result in underground explosions.

Ventilation also plays an important role in the spontaneous heating of coal in an underground coal mine. If the ventilation rate is too high, heat is carried away by convection. If the ventilation rate is too low, the reaction rate becomes oxygen-limited. It has been found that there is an optimum ventilation flow to produce the maximum rate of temperature rise at the critical ambient temperature. Ventilation controls that are well constructed will reduce air contamination, power and fan maintenance costs.

The basic principle underlying mine ventilation is that air always moves from high pressure regions to low pressure regions. Therefore, in order to get the air to flow from the intake to the exhaust, the exhaust air must be at a lower pressure than the intake. As fresh air is pulled into the mine, contaminated air must be drawn out. The fresh air and contaminated air streams must be segregated to prevent contamination of the fresh air entering the mine and to ensure that fresh air is maintained at a higher pressure than the pressure at the entrance of the exhaust system where contaminated air and fresh air commingle.

If shafts are used as the two main airways, the intake airway is called the downcast shaft, and the exhaust airway is referred to as the upcast shaft. Sometimes one shaft can be split to provide both an intake and exhaust airway. If this pressure difference exists naturally between the two airways, then the mine has natural ventilation. Natural ventilation is one of the two methods of ventilating a mine. The other method is mechanical ventilation where fans are used to create the pressure differential.

Stoppings are used to prevent contamination of intake air with return air and to direct air to where it is needed so as to keep intake air from short-circuiting to the exhaust before it reaches the working area. Seals are also used to contain water or liquid-like mine wastes (tailings or slurry). Failure of a seal or stopping could result in a disastrous inundation of an underground mine or expose miners to unacceptable risks through the contamination of fresh air with toxic gases.

Seals are typically built of concrete blocks, sand fill, or other incombustible material. They are sealed tightly against the floor and ribs (i.e. sides) of a mine roadway so that no air can leak through. Porous stoppings such as concrete block stoppings are usually plastered with a cementitious coating on the high-pressure side to reduce air leakage.

Sometimes stoppings have a door, e.g. air-lock, in them to allow miners to pass through. Man doors are not meant to be ventilation controls, but if a man door is propped open it can affect airflow and may cause intake air to short circuit into the return air.

Because intake and return air frequently cross paths at intersections within the mine, overcasts and undercasts are used to permit the two air currents to cross without the intake air short-circuiting into the exhaust. Overcasts are like enclosed bridges built above the normal back level of the mine. Undercasts are like tunnels built below the normal floor of the mine. Undercasts are seldom used in a mine because they are apt to fill with water or debris which would severely slow down the flow of air through them. Overcasts are used more often and are typically constructed with planar concrete block walls sealed against the ribs and floor, and with some type of airtight roof made of pre-stressed concrete, railroad ties, metal sheeting or steel beams. Steel and other metals can sometimes be difficult to use underground due to fumes caused from welding causing air contamination.

In areas of heavy traffic, such as along long haulage roads, mine doors are usually hung in pairs while being used as ventilation controls. They are used to completely close off a mine passage yet open to allow equipment and people to pass through. Mine doors are generally used to keep air from flowing to areas where it is not needed. Mine doors can also be used to isolate separate splits of air. Mine doors are usually hung in pairs, forming an air lock that prevents unnecessary air flow when one of the pairs is opened. The doors should always be opened and closed one at a time in order to maintain the air lock. Mine doors are always hung so that the ventilating air pressure will push them closed if they are accidentally left open. However, the doors should always be closed after you pass through them. Some doors must be closed manually while others can be closed automatically.

Some mines also use fire doors to control airflow in the event of fire. They are usually built at shaft stations and other strategic locations so that if there is a fire they can be closed to serve as a barrier to the fire and contaminated air. In some mines the fire doors will close automatically when the carbon monoxide in the area reaches a certain level. Some mines will also have rollup doors in shop areas which close automatically when a mine fire warning is given.

When ventilation controls such as seals, stoppings, overcasts, and undercasts are installed in underground mines, they are required to meet the safety standards specified in 30 CFR 75.333. This safety standard requires that ventilation which includes overcasts, undercasts, shaft partitions, seals, stoppings, and regulators be constructed of noncombustible material. Noncombustible material is defined in 30 CFR 75.301 as a material which when used to construct a ventilation control results in a control that will continue to serve its intended function for one hour when subjected to a fire test incorporating an American Society for Testing and Materials, International, ASTM E-119-88 temperature/time heat input, or equivalent. Additionally, the ventilation control must meet a flexural strength that is equal to or greater than a conventional 20 cm hollow core concrete block stopping. The 20 cm hollow core concrete block with mortared joints has been tested and shown to have a minimum strength of 190 kg/m$^2$. ASTM E-72-80 is used to determine the flexural strength. Also, sealants or coatings applied to ventilation controls to reduce air leakage must have a flame spread index of 25 or less. The flame spread index test specified in 30 CFR 75.333 is detailed in ASTM E-162-87. The aforementioned codes, regulations, and specifications are intended to serve as examples only with it being understood that other codes, regulations, and specifications can apply depending on the application and the jurisdiction.

The basis for the safety standard of fire endurance and flexural strength relates to concrete block. Concrete block has long been the material of choice for the construction of stoppings and seals. However, the construction of a concrete block stopping is labor intensive and time consuming. Concrete blocks are heavy, a typical 20 cm wide by 20 cm high by 41 cm long hollow concrete block has an average mass of approximately 18 kg, and injuries from carrying and lifting the blocks often result. Developments in material science have resulted in newer, lighter cementitious materials to replace the use of concrete block, particularly for the construction of retaining walls, stoppings, and seals.

SUMMARY

Provided is a convex, front-to-rear tapered building block formed of a cementitious material, e.g. geopolymer, or cement. The block is preferably pre-cast, but may be cast on-site as needed. The block is primarily intended for use in the construction of mine stoppings or seals by stacking a plurality of blocks in ascending layers between the walls of a mine shaft. The blocks, when assembled, form a parabolic, i.e. arcuate, wall which possesses superior compressive strength against shock waves from explosions as compared to a traditional flat wall, i.e. substantially non-parabolic wall.

The block may be formed with annular or semi-annular, e.g semicircular, cylindrical cavities so as to create annular cylindrical channels through blocks stacked within the assembled wall. The channels can include smaller radius pathways through which linear reinforcements may be installed and larger pathways through which larger reinforcements can pass. The annular and semi-annular cavities are also useful to reduce the mass of each block, thus yield more efficient material handling when compared to solid blocks. The annular cavities also add to strength through the formation of internal arch structures. The cylindrical pathways can be filled with a cementitious material for reinforcement so as to create a more permanent structure or "dry stacked" to create a temporary structure which can be subsequently deconstructed and moved for reassembly elsewhere.

BRIEF DESCRIPTION OF THE DRAWINGS

FIG. 7 depicts a perspective view of one embodiment of the subject structural block utilizing left and right mated blocks.

FIG. 8 depicts a plan view of the top surface of the structural blocks of FIG. 7.

DETAILED DESCRIPTION

Figure 1:
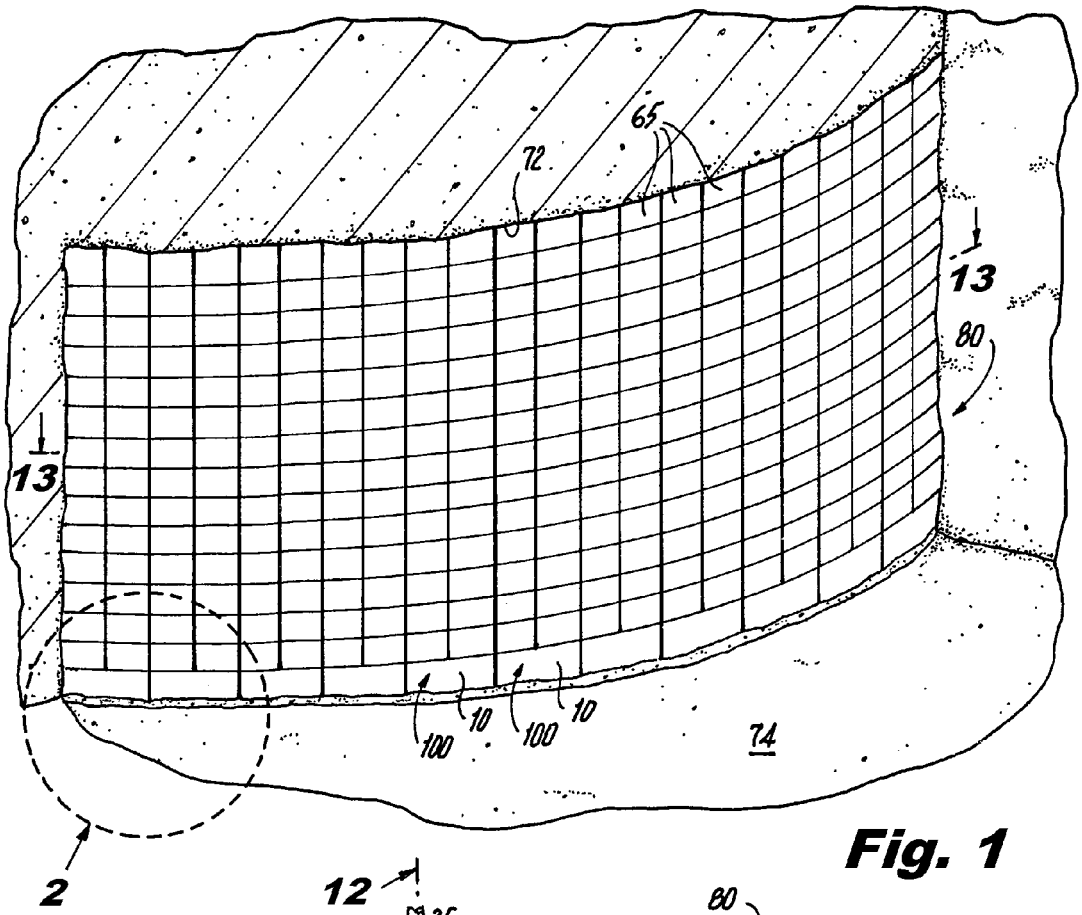
FIG. 1 depicts a parabolic wall constructed from the subject structural block.
Figure 2:
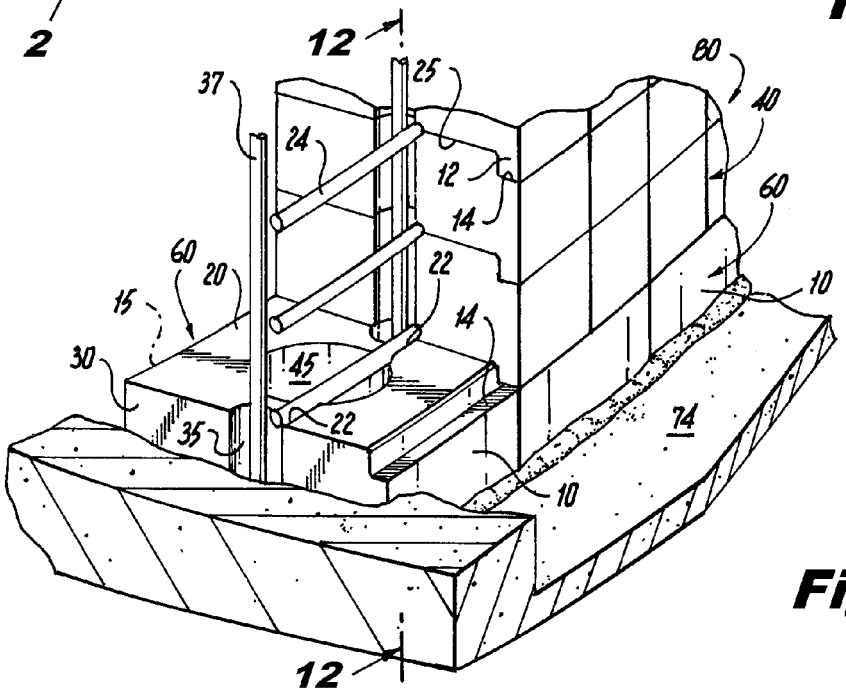
FIG. 2 depicts a partial cutaway view of a block assembly with vertical and lateral supports.

Provided is a convex, front-to-rear tapered structural block 100 formed of a geopolymer or similar cementitious material or cement. The block 100 is preferably pre-cast, but may be cast on-site as needed. When properly assembled, the convex blocks 100 form a parabolic wall 80. The length of a parabolic wall 80 constructed from the block 100 is related to its arc radius and thus the angle measure on the anterior face 10 and the posterior face 15 of the block 100.

A structural block 100 embodiment, as shown in FIGS. 1-16, is stackable so as to mate or interlock with other blocks 100 to reinforce any structure assembled therefrom. In one embodiment, the block 100 of the present innovation is made available as a foundation-block 60, see FIG. 3, and a wall-block 40, see FIG. 2. As depicted in FIGS. 1-2 and 9-12, the wall-blocks 40 are preferably stacked in vertically ascending horizontal layers atop a bottom layer of foundation-blocks 60 or alternatively wall-blocks 40 and stacked in subsequent horizontal rows on top of each other until the head-blocks 65, i.e. roof-blocks 65, can be utilized in the last row abutting the roof 72.

Each wall-block 40 possesses a key 12, e.g. a lip 12, extending down from the bottom face 25 of the block 100 from the anterior face 10 back towards the posterior face 15, preferably at the bottom of the substantially planar anterior face 10 which extends downward in a substantially planar continuation of the face, extending part-way along the substantially planar bottom face 25 toward the posterior face 15 of the block 100. The block 100 further possesses a keyway 14, or seat 14, to receive the key 12. The keyway 14 is preferably a groove along the joint where the anterior face 10 of the wall-block 40 and the top face 20 of the wall-block 40 meet and is configured to receive the key 12 from the bottom face 25 or base 25 of a block 100 stacked upon the top face 20 of a lower block 100 so as to form a mechanical mating and/or friction fit arrangement.

The mating of the key 12 and keyway 14 ensures correct alignment of each block 100 and the integrity of the completed wall 80. The key-to-keyway mating also aids in the transfer of the load between layered blocks 100. In one embodiment, the wall-block 40 preferably possesses at least one central aperture 45 running from the top face 20 to the bottom face 25. One purpose of the central aperture 45 is mass reduction. An additional purpose of the central aperture 45 is to provide a pathway through which a vertical support 33 may pass. Yet another purpose of the central aperture 45 is to provide a passageway which terminates at the floor 74 for introducing a cementitious filling into the wall 80 for reinforcement. The central aperture 45 vertically aligns with a vertical support aperture 37 in the block 100 above and the block 100 below in a staggered block configuration. In a still further embodiment, the blocks 100 possess vertical groove 35 on the each lateral face 30 which are configured to mate with other vertical grooves 35 when stacked next to each other so as to form annular, cylindrical vertical support apertures 37 which extend vertically between the blocks 100. As depicted in FIGS. 2 and 9-12, the vertical support apertures 37 formed by the vertical groove 35 can be utilized for the installation of vertical supports 35 therein. The vertical supports 35 are preferably fabricated from steel.

A lateral groove 22 runs across the top face 20 of the block 100 at roughly the same arc radius as the vertical groove 35 and central aperture 45 and with no greater than the same arc angle measure as the anterior face 10 of the block 100 and no less than the arc angle measure of the posterior face 15. In a preferred embodiment, the width of the lateral groove 22 is approximately 1.5 inches (3.8 cm) and is semi-annular in geometry so as to receive an arc shaped lateral support 24 along the length of the wall 80. In a preferred embodiment, the lateral supports 24 may be mechanically affixed to the vertical supports 33 by tying with wire or clamping. In some applications, the lateral supports 24 can be welded to the vertical supports 33.

As an example, the dimensions of a wall-block 50 embodiment as depicted in FIG. 7, are (a) a length of 16 inches (40.64 cm) along the left lateral face 31 and the right lateral face 33 including the wall-block body 51 and key 12, (b) a length of 14.5 inches (36.83 cm) along the along the left lateral face 31 and the right lateral face 32 including the wall-block body 51 but excluding the key 12, (c) a length of 1.5 inches (3.81 cm) along the left side face and the right side face excluding the wall-block body 51 but including the key 12, 1.5 inches (3.81 cm), (d) an arc length of 8.35 inches (21.21 cm) along the anterior face 10, an arc length of 7.3 inches (18.54 cm) along the posterior face 15, (e) an arc angle of approximately 2°, (f) a height of 5 inches (12.7 cm) along the wall-block body 51, (g) a 5 inch (12.7 cm) tall key 12 extending 1.5 inches (3.81 cm) anteriorly from the anterior end of the wall-block body 51 and vertically offset down the anterior face 10 of the half-wall-block body 51 approximately 1.25 inches (3.18 cm), (h) a 0.25 inch×0.25 inch (6.35 mm×6.35 mm) top chamfer 43 in the top anterior edge of the wall-block body 41, and (i) a 0.25 inch×0.25 inch (6.35 mm×6.35 mm) bottom chamfer 44 in the posterior bottom edge of the key 12. When one wall-block 50 is placed above another wall-block 50, the bottom chamfers 44 of the top wall-block 50 mates with the bottom chamfer 44 of the bottom block 50. Ideally the blocks 100 are stacked so as to offset their vertical seams 48, thus a wall-block 50 will engage two wall-blocks 50 on its top face 20 and two wall-blocks 50 on its bottom face 25.

The aforementioned wall-block 50 embodiment is preferably comprised of two versions, a left-wall-block 55 and a right-wall-block 57. Each wall-block 50 possesses the same keyway 14, i.e. seating groove 14, and key 12 and the same arc angle measure across its anterior face 10. In a preferred embodiment, the left-wall-block and right-wall-block are substantially half large-wall-blocks 40 which allow the user to adjust the length of the assembled wall without blocking the central apertures 45 and vertical support apertures 37 so as to interfere with the use of vertical supports 33 to reinforce the wall 80.

Figure 9:
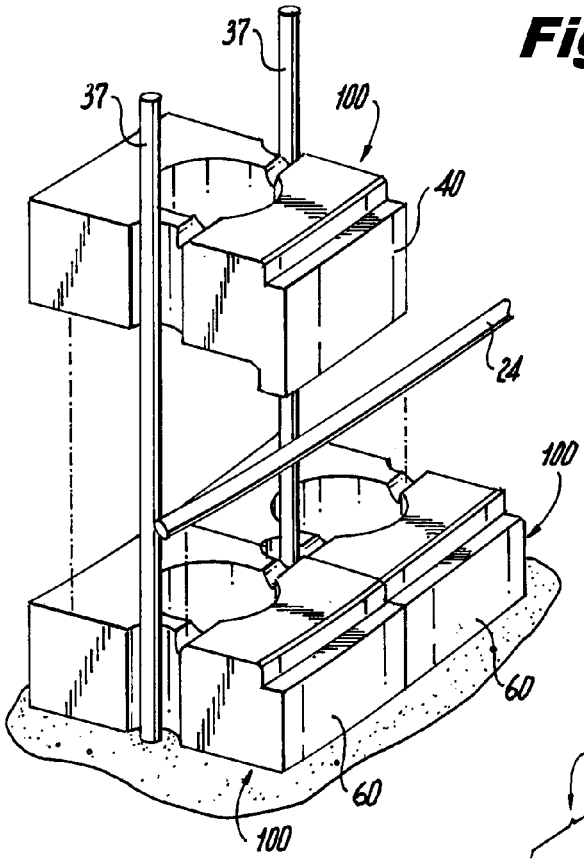
FIG. 9 depicts an exploded perspective view of the wall assembly of the structural blocks of FIG. 3.
Figure 10:
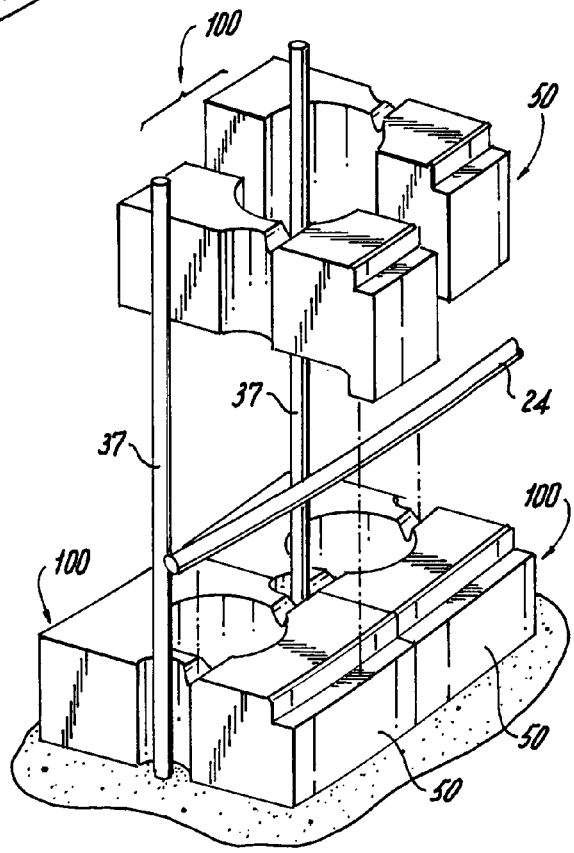
FIG. 10 depicts an exploded perspective view of the wall assembly of the structural blocks of FIG. 5.
Figure 11:
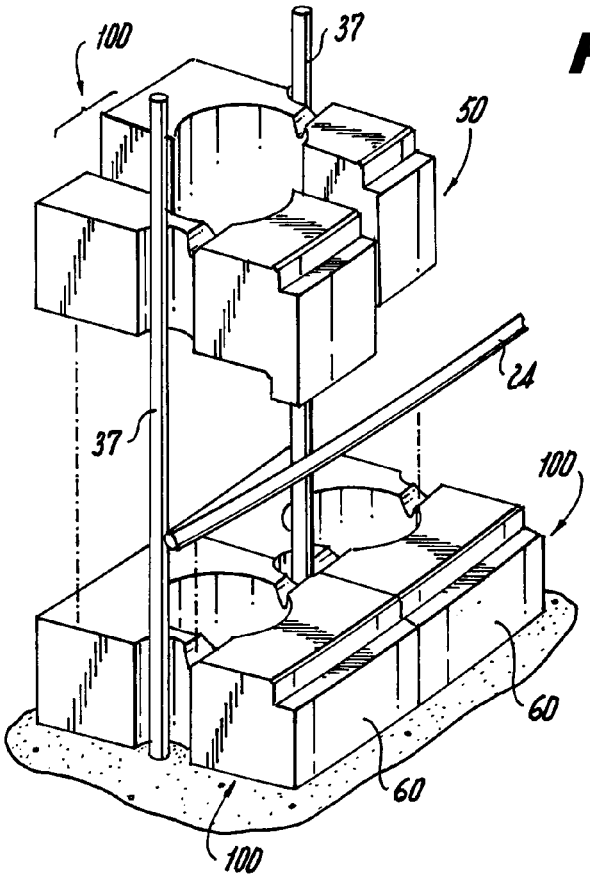
FIG. 11 depicts an exploded perspective view of the wall assembly of the structural blocks of FIG. 7.
Figure 12:
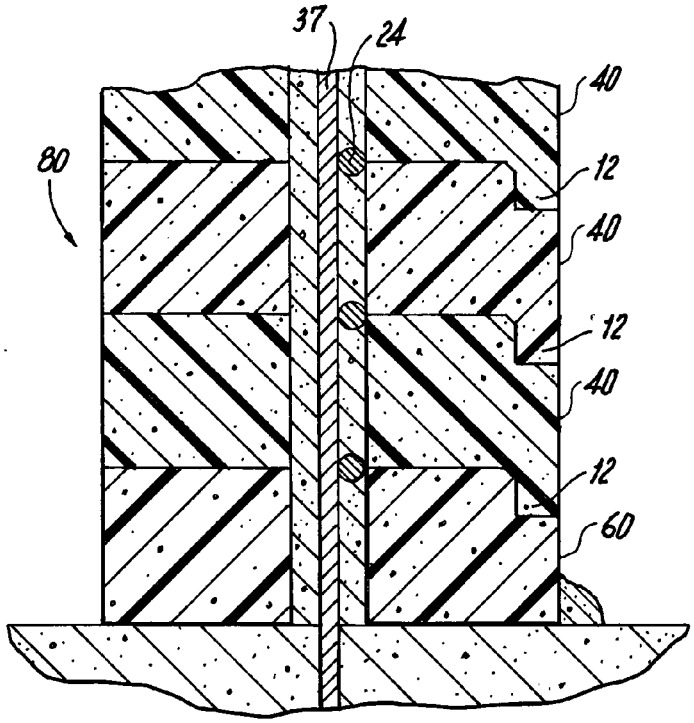
FIG. 12 depicts a cross-sectional view of a wall assembly of the subject structural block.
Figure 13:
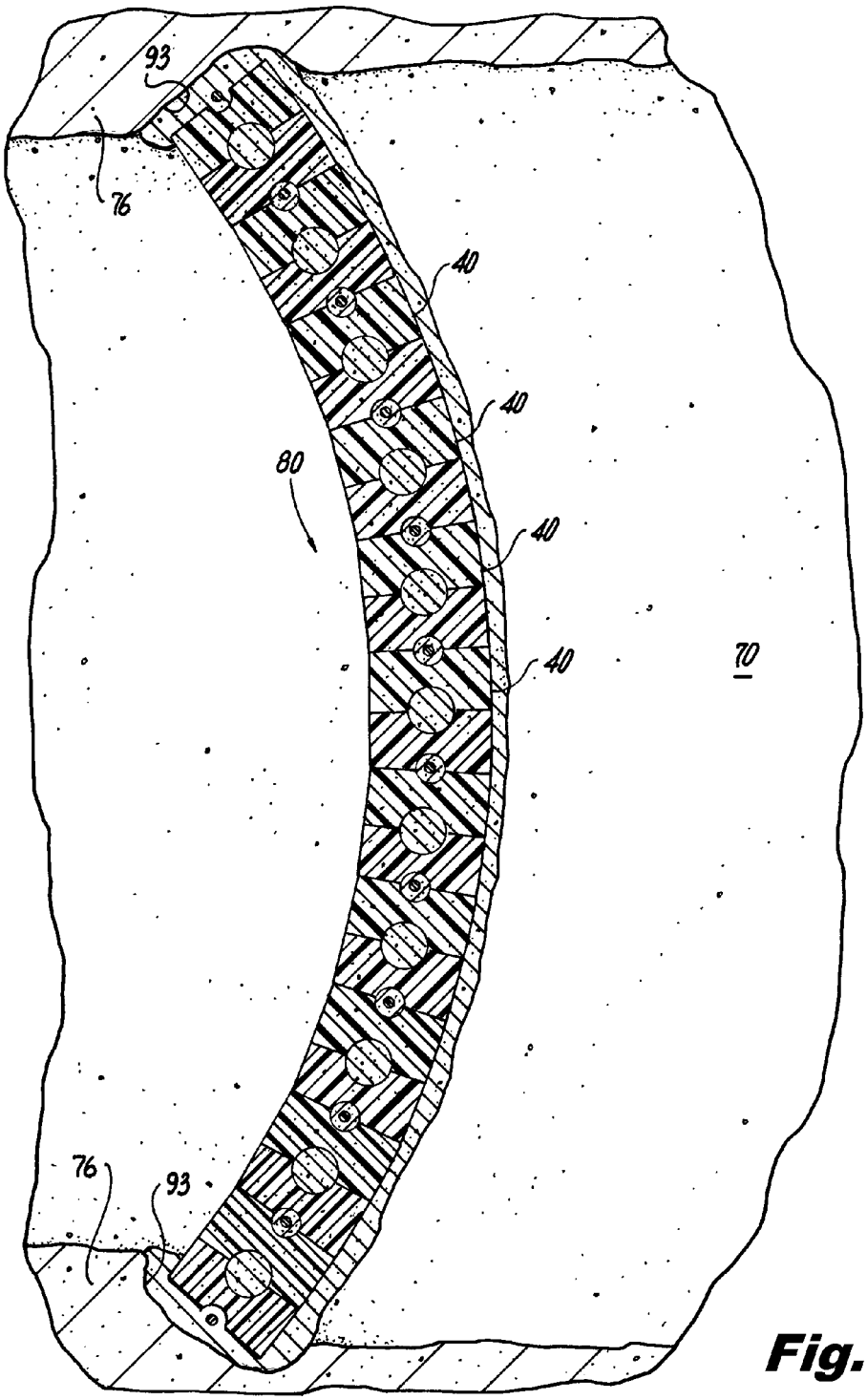
FIG. 13 depicts the subject structural block assembled as a parabolic wall with ends embedded in the ribs of a mine shaft.
Figure 14:
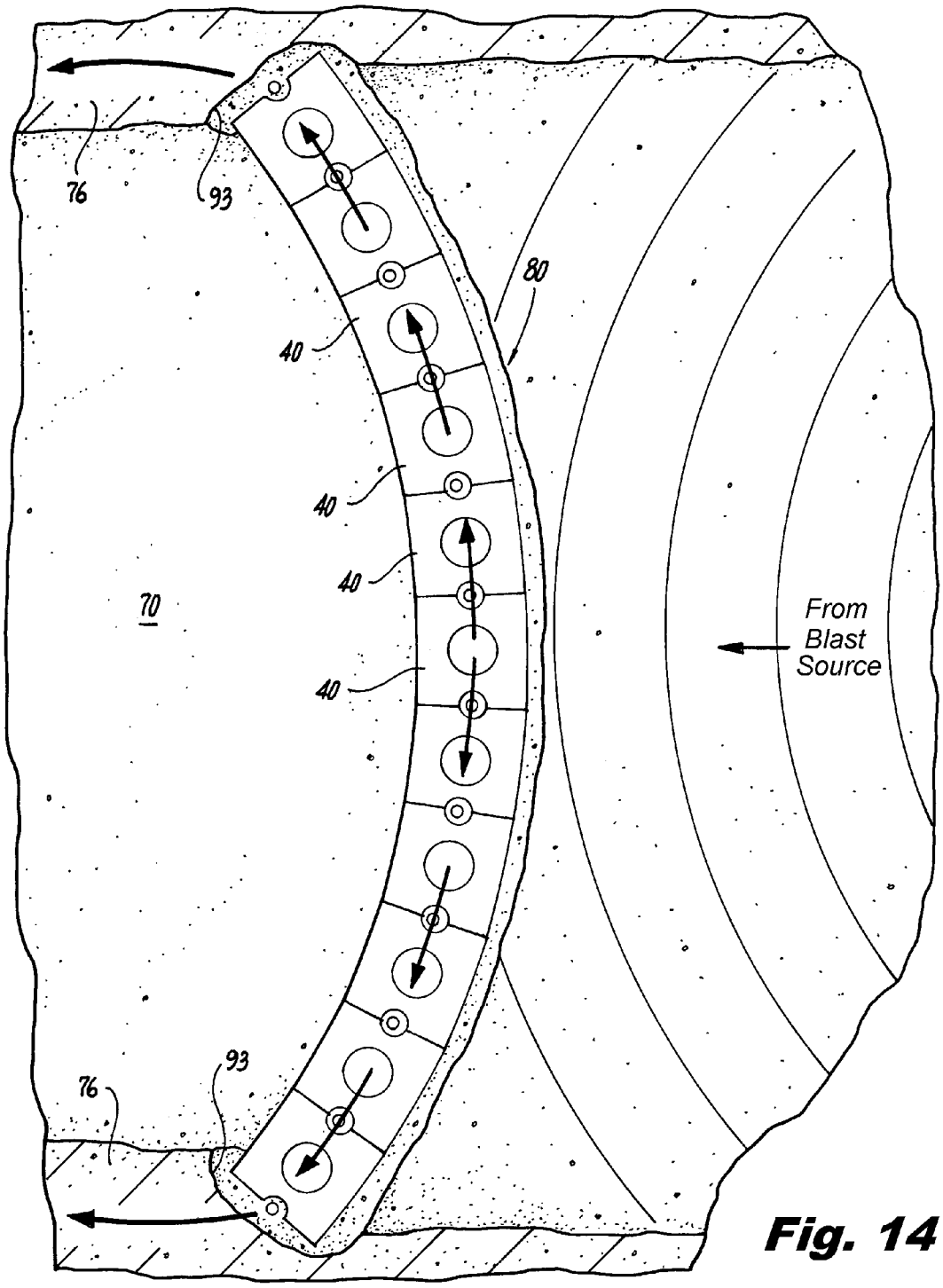
FIG. 14 depicts a plan view of the subject structural block assembled as a parabolic wall with ends embedded in the ribs of a mine shaft and refocusing the energy from a shock wave.
Figure 15:
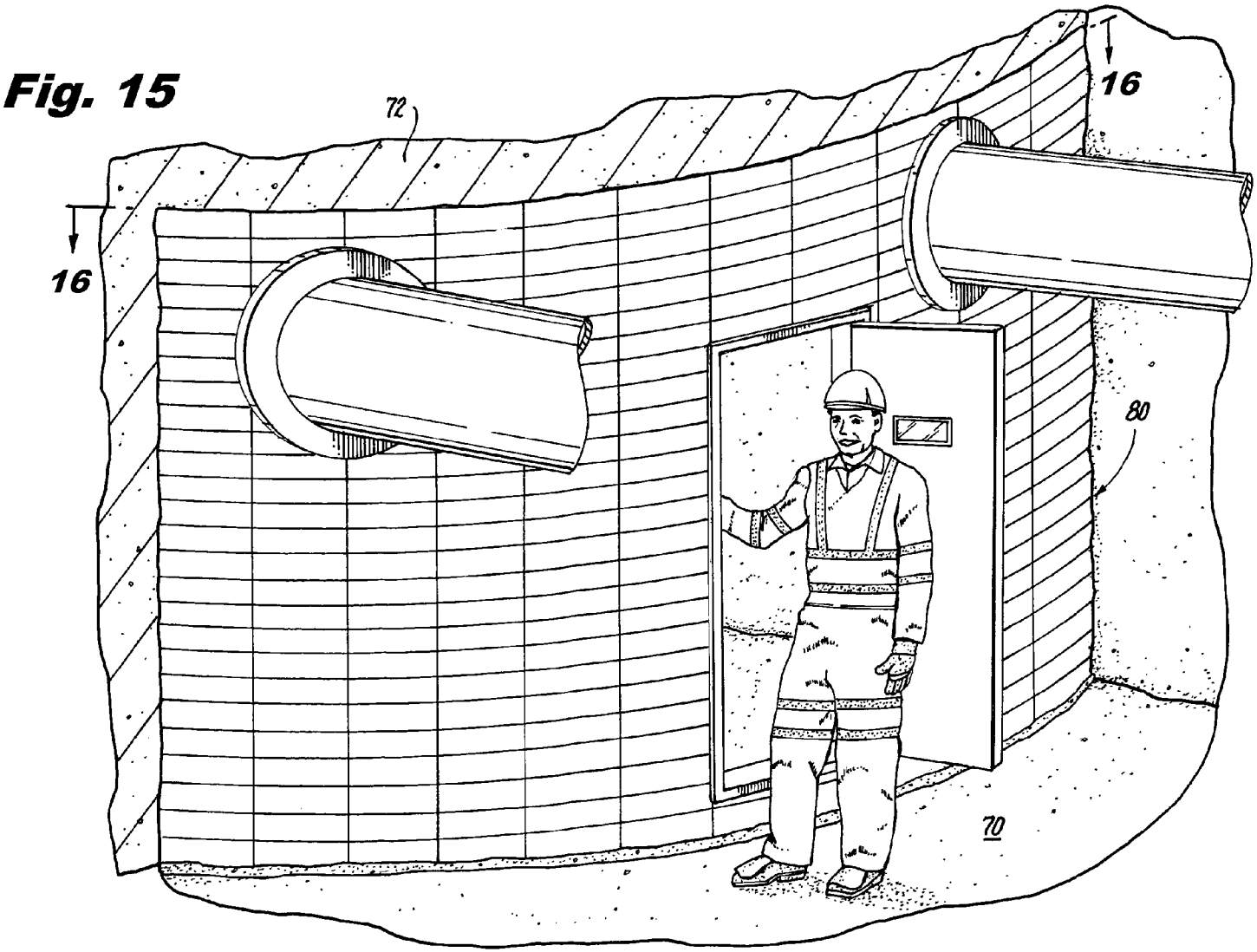
FIG. 15 depicts a perspective view of the subject structural block assembled as a parabolic wall as part of a ventilation control device with an air-lock.
Figure 16:
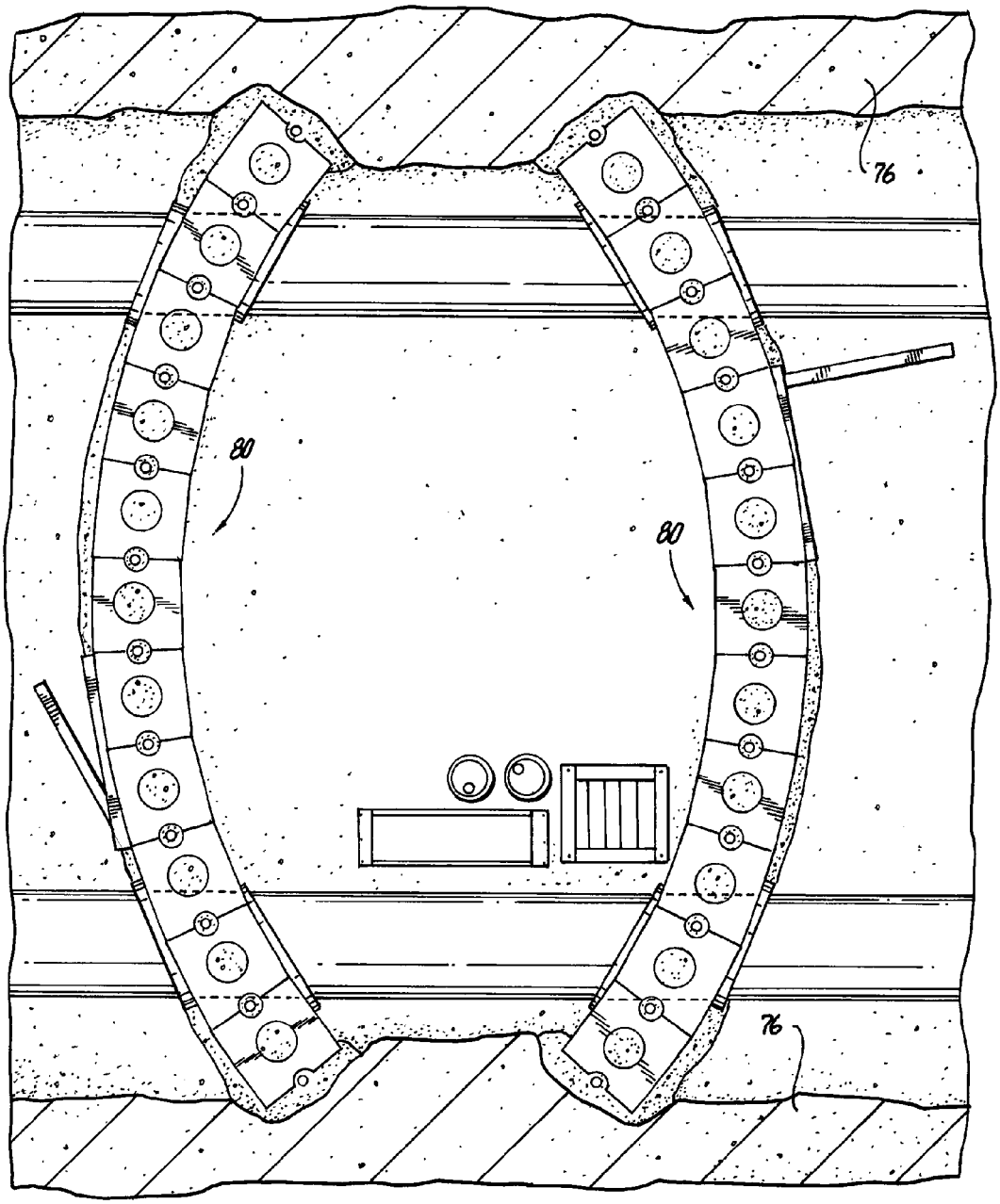
FIG. 16 depicts a plan view of a safe room and air-lock as part of a ventilation control device in a mine shaft.

As an example, the dimensions of a large-wall-block 40 embodiment, as depicted in FIG. 9, for use with an 18 ft (5.5 m) wide roadway are (a) a length of 16 inches (40.64 cm) along the left lateral face 31 and the right lateral face 32 including the large-wall-block body 41 and key 12, (b) a length of 14.5 inches (36.83 cm) along the along the left side face and the right side face including the large-wall-block body 41 but excluding the key 12, (c) a length of 1.5 inches (3.81 cm) along the left lateral face 31 and the right lateral face 32 excluding the large-wall-block body 41 but including the key 12, 1.5 inches (3.81 cm), (d) an arc length of 16.7 inches (42.42 cm) along the anterior face 10, an arc length of 14.6 inches (37.08 cm) along the anterior face, (e) an arc angle of approximately 4°, (f) a height of 5 inches (12.7 cm) along the large-wall-block body 41, (g) a 5 inch (12.7 cm) tall key 12 extending 1.5 inches (3.81 cm) anteriorly from the anterior end of the large-wall-block body 41 and vertically offset down the anterior face 10 of the large-wall-block body 41 approximately 1.25 inches (3.18 cm), (h) a 0.25 inch×0.25 inch (6.35 mm×6.35 mm) top chamfer 43 in the top anterior edge of the large-wall-block 40, and (i) a 0.25 inch×0.25 inch (6.35 mm×6.35 mm) bottom chamfer 44 in the posterior bottom edge of the key 12. When one wall-block 40 is placed above another large-wall-block 40, the bottom chamfers 44 of the top large-wall-block 40 mates with the bottom chamfer 44 of the bottom large-wall-block 40. Ideally the large-wall-blocks 40 are stacked so as to offset their vertical seams 48, thus a large-wall-block 40 will engage two large-wall-blocks 40 on its top face 25 and two large-wall-blocks 40 on its bottom face 25.

Figure 3:
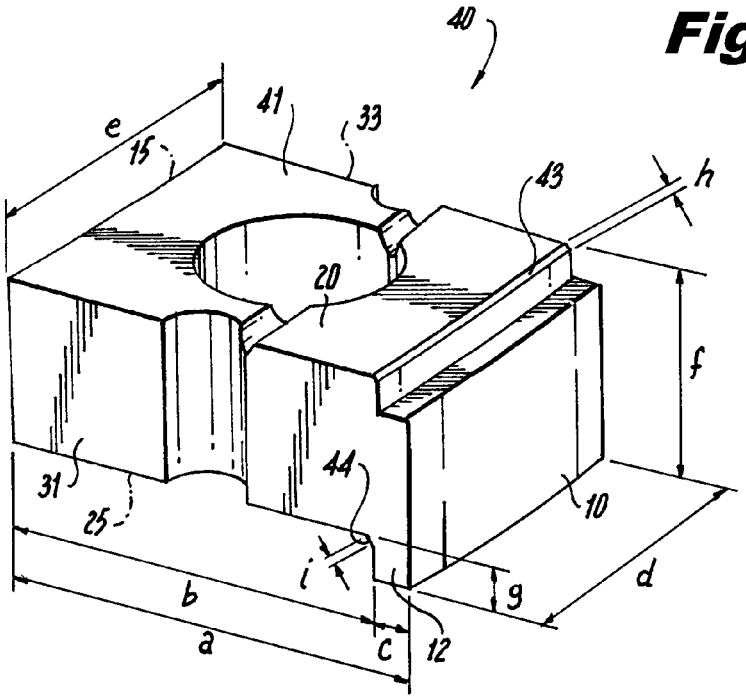
FIG. 3 depicts a perspective view of a foundation-block embodiment of the subject structural block.
Figure 4:
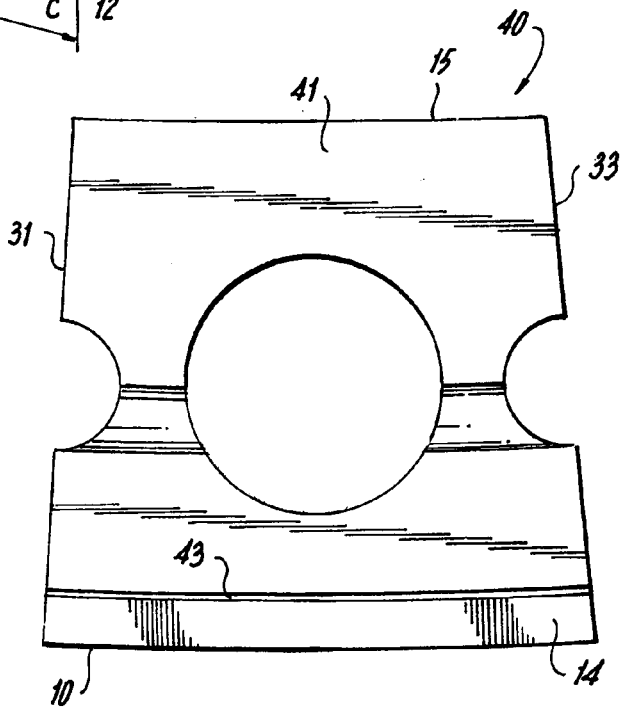
FIG. 4 depicts a plan view of the top face of one embodiment of the subject structural block.
Figure 5:
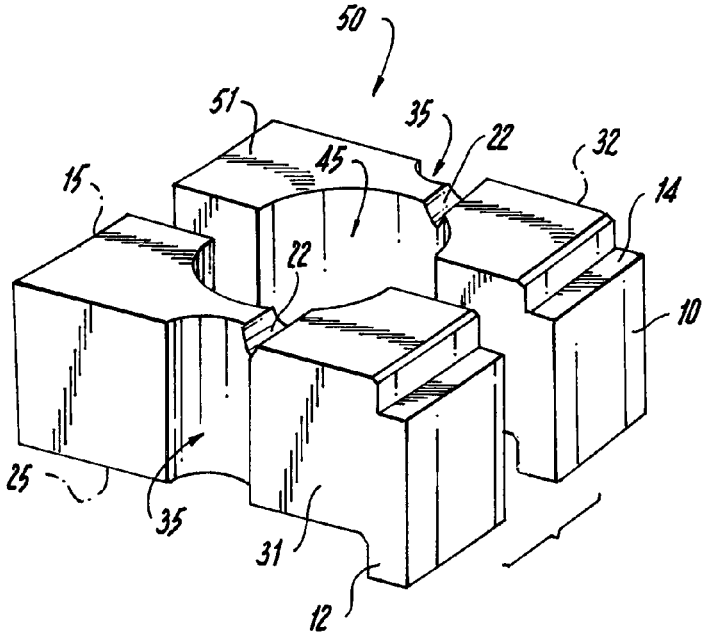
FIG. 5 depicts a perspective view of one embodiment of the subject structural block utilizing left and right mated blocks.
Figure 6:
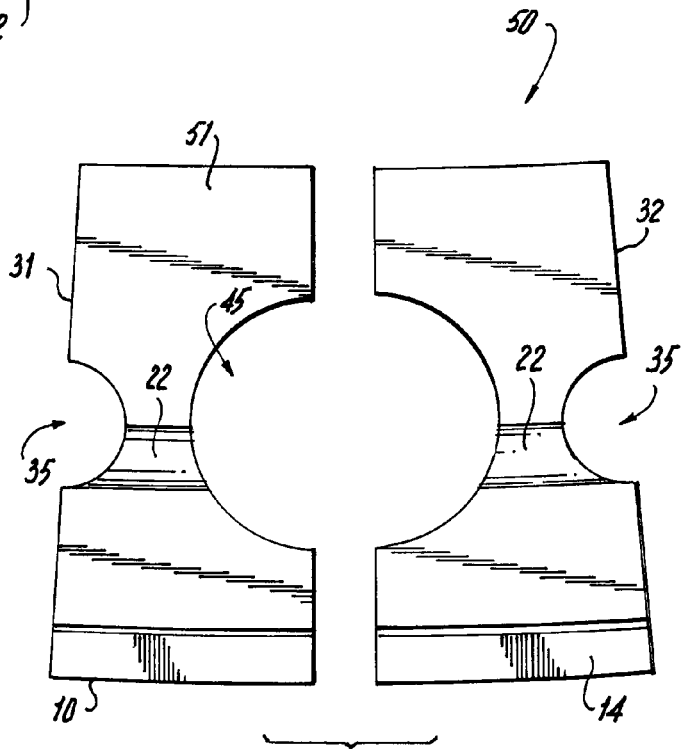
FIG. 6 depicts a plan view of the top surface of the structural blocks of FIG. 5.

As depicted in FIG. 3, a foundation-block 60, i.e. starter block, is substantially identical to a wall-block 50 or large-wall-block 40 without the key 12 for seating. A further embodiment utilizes a head-block 65, i.e. roof-block 65, which possesses a key 12 formulated or cured to possess a lower compressive strength relative to the wall-block 50 to allow for settling of a mine roof 72.

As depicted in FIGS. 13-16, an underground mine seal or stopping may be by stacking layers of wall-block 40 atop the foundation-block 60. A cementitious product either identical or similar to the cementitious material from which the blocks 100 are fabricated may be used as a mortar, a coating, and/or a filler. The blocks 100 are mated by key 12 to keyway 14 and form a parabolic wall 80 across a roadway 70. The ends of the wall 80 terminate in excavated restraining pockets 93 within the ribs 76 so as to redirect and disperse some of the force from a blast wave along the arc of the wall 80 and into the ribs 76. A parabolic wall 80 is better suited than a flat-faced wall, i.e. a wall whose face is substantially an un-curved planar wall, for withstanding the forces of shock wave from a blast as measured by ASTM E72-80—Section 12, "transverse loading of a vertical specimen." A parabolic wall absorbs some of the shock wave from a blast but redirects the remainder along the arc length of the parabolic wall 80 and into the ribs 76 of a mine shaft. Ideally, a cementitious coating for sealing covers the surface of the parabolic wall 80 and its joints along the mine shaft walls 76, i.e. ribs 76, floor 74, and roof 72.

The blocks 100 may be utilized to create walls 80 for safe rooms, ventilation control devices, dams, and similar underground structures which require sealing. Such walls 80 can also be utilized to create air- to allow miners to pass from areas of high pressure to areas of low pressure without short-circuiting air flow. Additional uses include the construction of walls, e.g. retaining walls, and other walled civil engineering projects in loose soil. When cast from geopolymers, these blocks 100 have the added advantage of being faster to assemble than traditional concrete blocks due to reduced mass, and result in improved workplace ergonomics and safety.

One such useful cementitious material is HySSIL™, a geopolymer available from HySSIL PTY LTD. Geopolymers are chains or networks of mineral molecules linked with co-valent bonds. Hardened geopolymers are x-ray amorphous at ambient and medium temperatures and x-ray crystalline at temperatures >500° C. They are created in an alkaline medium, e.g. (Na, K, Ca) hydroxides and alkali-silicates yielding poly(silicates)-poly(siloxo) types of geopolymers or poly(silico-aluminates)-poly(sialate) types of geopolymers, or in an acidic medium, e.g. Phosphoric acid yielding poly (phospho-siloxo) and poly(alumino-phospho) types of geopolymers. As an example, one of the geopolymeric precursors, MK-750 (metakaolin) with its alumoxyl group —Si—O—Al—O, reacts in both systems, alkaline and acidic. Siloxo-based and organo-siloxo-based geopolymeric species also react in both alkaline and acidic medium.

Geopolymer terminology is based on different chemical units, essentially for silicate and aluminosilicate materials, classified according to the Si:Al atomic ratio:

Si:Al=0, siloxo

Si:Al=1, sialate (acronym for silicon-oxo-aluminate of Na, K, Ca, Li)

Si:Al=2, sialate-siloxo

Si:Al=3, sialate-disiloxo

Si:Al>3, sialate link.

See *IUPAC Symposium on Long-Term Properties of Polymers and Polymeric Materials*, Stockholm 1976, Topic III: Joseph Davidovits, Solid-Phase Synthesis of a Mineral Blockpolymer by Low Temperature Polycondensation of Alumino-Silicate Polymers.

Silicates and their crystal structures were originally classified based on the concept of the ionic theory by L. Pauling. The fundamental unit is a tetrahedral complex consisting of a small cation such as $Si^{4+}$, or $Al^{3+}$ in tetrahedral coordination with four oxygens. The structures involved with geopolymerization are in fact siloxonate/sialate covalent constructs, not ionic. Geo-chemical syntheses are carried out through oligomers (dimer, trimer, tetramer, pentamer) which provide the actual unit structures of the three dimensional macromolecular edifice.

Geopolymers are generally comprised of the following molecular units (i.e. chemical groups):

—Si—O—Si—O— siloxo, poly(siloxo)

—Si—O—Al—O— sialate, poly(sialate)

—Si—O—Al—O—Si—O— sialate-siloxo, poly(sialate-siloxo)

—Si—O—Al—O—Si—O—Si—O— sialate-disiloxo, poly(sialate-disiloxo)

—P—O—P—O— phosphate, poly(phosphate)

—P—O—Si—O—P—O— phospho-siloxo, poly(phospho-siloxo)

—P—O—Si—O—Al—O—P—O— phospho-sialate, poly(phospho-sialate)

—(R)—Si—O—Si—O—(R) organo-siloxo, poly-silicone

—Al—O—P—O— alumino-phospho, poly(alumino-phospho)

—Fe—O—Si—O—Al—O—Si—O— ferro-sialate, poly (ferro-sialate).

Generally, geopolymers are developed and applied in 10 main classes of materials:

Waterglass-based geopolymer, poly(siloxonate), soluble silicate, Si:Al=1:0

Kaolinite/Hydrosodalite-based geopolymer, poly(sialate) Si:Al=1:1

Metakaolin MK-750-based geopolymer, poly(sialate-siloxo) Si:Al=2:1

Calcium-based geopolymer, (Ca, K, Na)-sialate, Si:Al=1, 2, 3

Rock-based geopolymer, poly(sialate-multisiloxo) 1<Si:Al<5

Silica-based geopolymer, sialate link and siloxo link in poly(siloxonate) Si:Al>5

Fly ash-based geopolymer

Ferro-sialate-based geopolymer

Phosphate-based geopolymer, AlPO4-based geopolymer

Organic-mineral geopolymer.

As an example: geopolymerization with metakaolin MK-750 involves three phases:

1. Alkaline depolymerization of the poly(siloxo) layer of kaolinite.
2. Formation of the ortho-sialate $(OH)_3$—Si—O—Al—$(OH)_3$ molecule.
3. polymerization (polycondensation) into higher oligomers and polymers.

The geopolymerization kinetics for Na-poly(sialate-siloxo) and K-poly(sialate-siloxo) are slightly different. This is probably due to the different dimensions of the $Na^+$ and $K^+$ cations, $K^+$ being bigger than $Na^+$. Polycondensation into a Na-poly(sialate-disiloxo)albite framework results in the more crystalline structure as shown below.

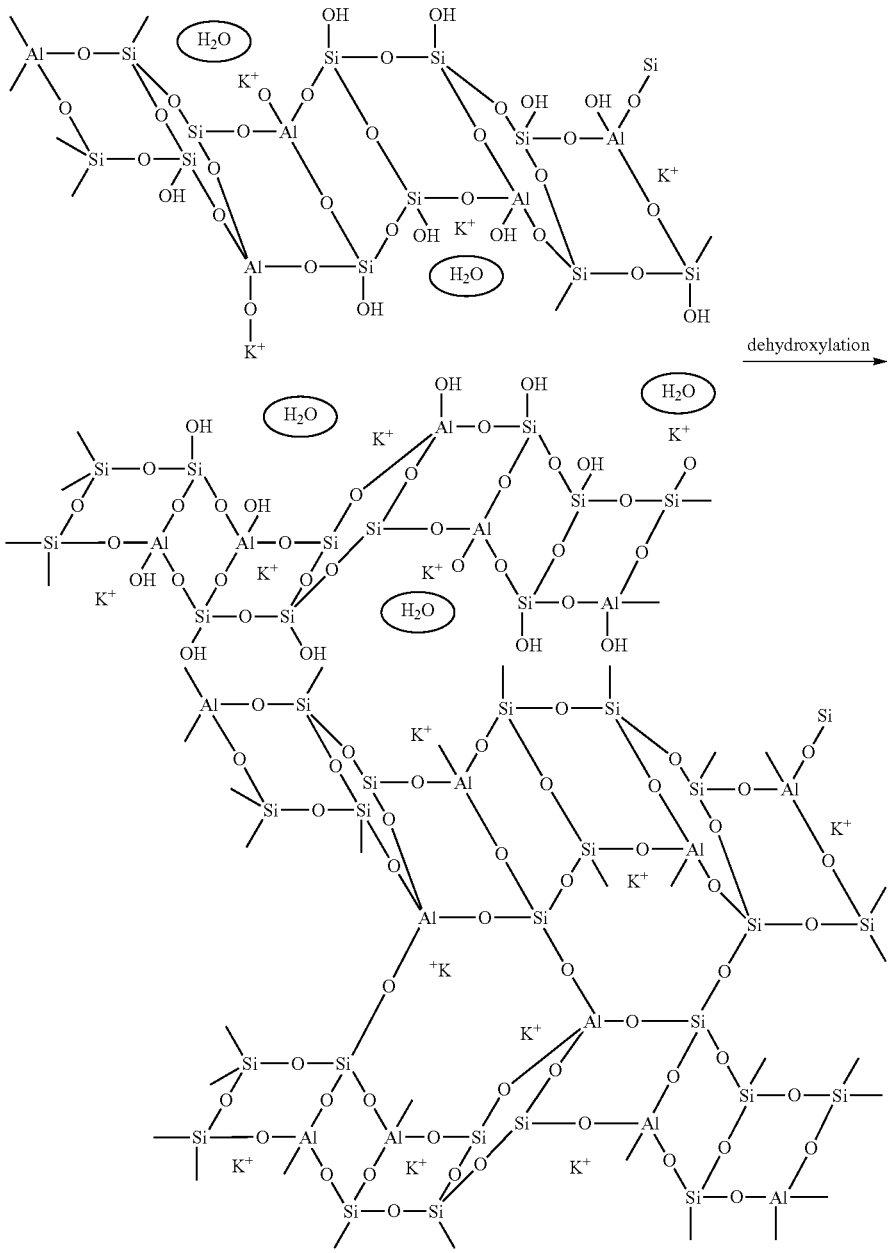

The geopolymer block 100 of a preferred embodiment has a density of approximately half that of concrete, but with similar durability and higher strength. The lower mass product possesses less embodied energy in its creation, requires less energy to transport than similar ordinary Portland cement concrete blocks, thus generating a cost savings in fuel and a benefit to the environment. The use of recycled fly ash in the preferred geopolymer results in a reduction of $CO_2$ emissions of approximately 60% and a block cast therefrom embodies approximately 60% less energy in its manufacture than a similar concrete block. The geopolymer block possesses a higher resistance to fire and chemicals as well as greater flexural and compressive strength. The geopolymer may be formulated and/or cured to possess a reduced compressive strength for use with the wall-block 40 laid at the top of the wall 80, i.e. head-block 65, in contact with the roof 72 to allow for some roof 72 convergence along the top layer.

A geopolymer formed block 100 has the advantage of being a "green" product whose environmental benefits result in a lower carbon footprint and can result in carbon credits for greenhouse gas mitigation which can then be used for expanded growth or sold in the carbon credit market.

Inert particulate materials (e.g. sand, rock, and/or crushed concrete) added to cement to influence the physical properties and/or economics of concrete.

What is claimed is:

1. A structural block system for constructing arcuate walls comprising:

a wall-block comprising:

a. a wall-block body cast from a cementitious product, said block body having a height, a convex anterior face, a concave posterior face, a length from said convex anterior face to said concave posterior face, a top face, a bottom face, a height from said top face to said bottom face, a right lateral face, a left lateral face, and a width from said left lateral face to said right lateral face wherein said width decreases from said anterior face to said posterior face;

b. at least one vertical support groove in said left lateral face of said wall-block body and at least one vertical support groove in said right lateral face of said block body, configured to form a vertical support aperture along a lateral face joint between two said structural blocks laid side-by-side wherein said vertical support grooves lie at the same arc radius across said width of said wall-block body;

c. a lateral groove forming an arc across said top face of said width of said wall-block, wherein said arcuate lateral groove possesses the same angle measure as the anterior face and passes across said vertical grooves in said lateral faces; and d. means to mechanically mate a plurality of said wall-block bodies together in a friction fit arrangement comprising at least one male connector and at least one female receiver configured to receive said male connector further comprising a large-wall-block comprising:

a. a large-wall-block body cast from a cementitious product, said large-wall-block body having height, a convex anterior face, a concave posterior face, a length, from said convex anterior face to said concave posterior face, a top face, a bottom face, a height from said top face to said bottom face, a left lateral face, a right lateral face, a width from said left lateral face to said right lateral face wherein said width is substantially twice the width of said wall-block and decreases from said anterior face to said posterior face;

b. at least one vertical support groove in said left lateral face of said large-wall-block body and at least one vertical support groove in said right lateral face of said block body, configured to form a vertical aperture along a lateral face joint between two said structural blocks laid side-by-side wherein said vertical support grooves lie at the same arc radius across said width of said wall-block body; and c. means to mechanically mate a plurality of said large-wall block bodies together in a friction fit arrangement comprising at least one male connector and at least one female receiver configured to receive said male connector;

d. a central aperture from said top face through said bottom face which lies along the same arc radius as said vertical grooves in said lateral faces;

further comprising a roof-block having less compressive strength than said large-wall-block and said wall-block wherein said roof block is laid between a top layer of said wall-blocks assembled as a wall and a mine roof in an underground wall assembly.

2. The structural block system of claim 1, further comprising a mated left-wall-block and right-wall-block configured with different arc lengths across said anterior faces and said posterior faces so as to horizontally offset the lateral face joint anteriorly to said vertical support aperture formed between two said structural blocks relative to said lateral face joint formed posteriorly to said vertical support aperture.

3. The structural block of claim 1, wherein said means to mechanically mate comprises an arcuate key and an arcuate keyway.

4. The structural block of claim 3, wherein said key and keyway are arranged across said anterior face of said wall-block body.

5. The structural block of claim 1, wherein said cementitious product is selected from the group consisting of cements and geopolymers.

6. The structural block of claim 5, further comprising an aggregate.

7. A structural block system for constructing arcuate walls comprising:

a wall-block formed of a geopolymer comprising:

a. a wall-block body cast from a cementitious product, said block body having a height, a convex anterior face, a concave posterior face, a length from said convex anterior face to said concave posterior face, a top face, a bottom face, a height from said top face to said bottom face, a right lateral face, a left lateral face, and a width from said left lateral face to said right lateral face wherein said width decreases from said anterior face to said posterior face;

b. at least one vertical support groove in said left lateral face of said wall-block body and at least one vertical support groove in said right lateral face of said block body, configured to form a vertical aperture along a lateral face joint between two said structural blocks laid side-by-side wherein said vertical support grooves lie at the same arc radius across said width of said wall-block body;

c. a lateral groove forming an arc across said top face of said width of said wall-block, wherein said arcuate lateral groove possesses the same angle measure as the anterior face and passes across said vertical grooves in said lateral faces; and d. means to mechanically mate a plurality of said wall-block bodies together in a friction fit arrangement comprising at least one male connector and at least one female receiver configured to receive said male connector further comprising a roof-block having less compressive strength than said wall block, wherein said roof block is laid between a top layer of said wall-blocks assembled as a wall and a mine roof in an underground wall assembly.

8. The structural block system of claim 7, further comprising a mated left-wall-block and right-wall-block configured with different arc lengths across said anterior faces and said posterior faces so as to horizontally offset the lateral face joint anteriorly to said vertical support aperture formed between two said structural blocks relative to said lateral face joint formed posteriorly to said vertical support aperture.

9. The structural block of claim 7, wherein said means to mechanically mate comprises an arcuate key and an arcuate keyway.

10. The structural block of claim 9, wherein said key and keyway are arranged across said anterior face of said wall-block body.

11. The structural block system of claim 7, further comprising a large wall-block comprising:

a. a large-wall-block body cast from a cementitious product, said large-wall-block body having a height, a convex anterior face, an concave posterior face, a length from said convex anterior face to said concave posterior face, a top face, a bottom face, a height from said top face to said bottom face, a left lateral face, a right lateral face, a width from said left lateral face to said right lateral face wherein said width is substantially twice the width of said wall-block and decreases from said anterior face to said posterior face;

b. at least one vertical support groove in said left lateral face of said large-wall-block body and at least one vertical support groove in said right lateral face of said block body, configured to form a vertical aperture along a lateral face joint between two said structural blocks laid side-by-side wherein said vertical support grooves lie at the same arc radius across said width of said wall-block body;

c. a lateral groove forming an arc across said top face of said width of said wall-block, wherein said arcuate lateral groove possesses the same angle measure as the anterior face and passes across said vertical grooves in said lateral faces; and d. means to mechanically mate a plurality of said large-wall-block bodies together in a friction fit arrangement comprising at least one male connector and at least one female receiver configured to receive said male connector; and e. a central aperture from said top face through said bottom face which lies along the same arc radius as said vertical grooves in said lateral faces.

* * * * *